US008632933B2

(12) United States Patent
Tujihiro et al.

(10) Patent No.: US 8,632,933 B2
(45) Date of Patent: Jan. 21, 2014

(54) DEVELOPER FOR ELECTROSTATIC LATENT IMAGE DEVELOPMENT AND IMAGE FORMING METHOD

(75) Inventors: Masami Tujihiro, Osaka (JP); Yukinori Nakayama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/554,462

(22) Filed: Jul. 20, 2012

(65) Prior Publication Data

US 2013/0029259 A1 Jan. 31, 2013

(30) Foreign Application Priority Data

Jul. 26, 2011 (JP) ..... 2011-163730
Jun. 4, 2012 (JP) ..... 2012-127436

(51) Int. Cl.
*G03G 9/08* (2006.01)

(52) U.S. Cl.
USPC ..... 430/108.3; 430/108.4; 430/123.51

(58) Field of Classification Search
USPC ..... 430/108.3, 108.4, 123.51
See application file for complete search history.

(56) References Cited

FOREIGN PATENT DOCUMENTS

JP 2005-275166 A 10/2005

*Primary Examiner* — Mark A Chapman

(57) ABSTRACT

A developer for electrostatic latent image development including a positively chargeable toner and a fatty acid metal salt is used, in which the fatty acid metal salt is a metal salt selected from the group consisting of zinc, calcium, and magnesium salts of fatty acids of 12 to 20 carbon atoms and has a certain volume average particle diameter and particle size distribution.

10 Claims, 1 Drawing Sheet

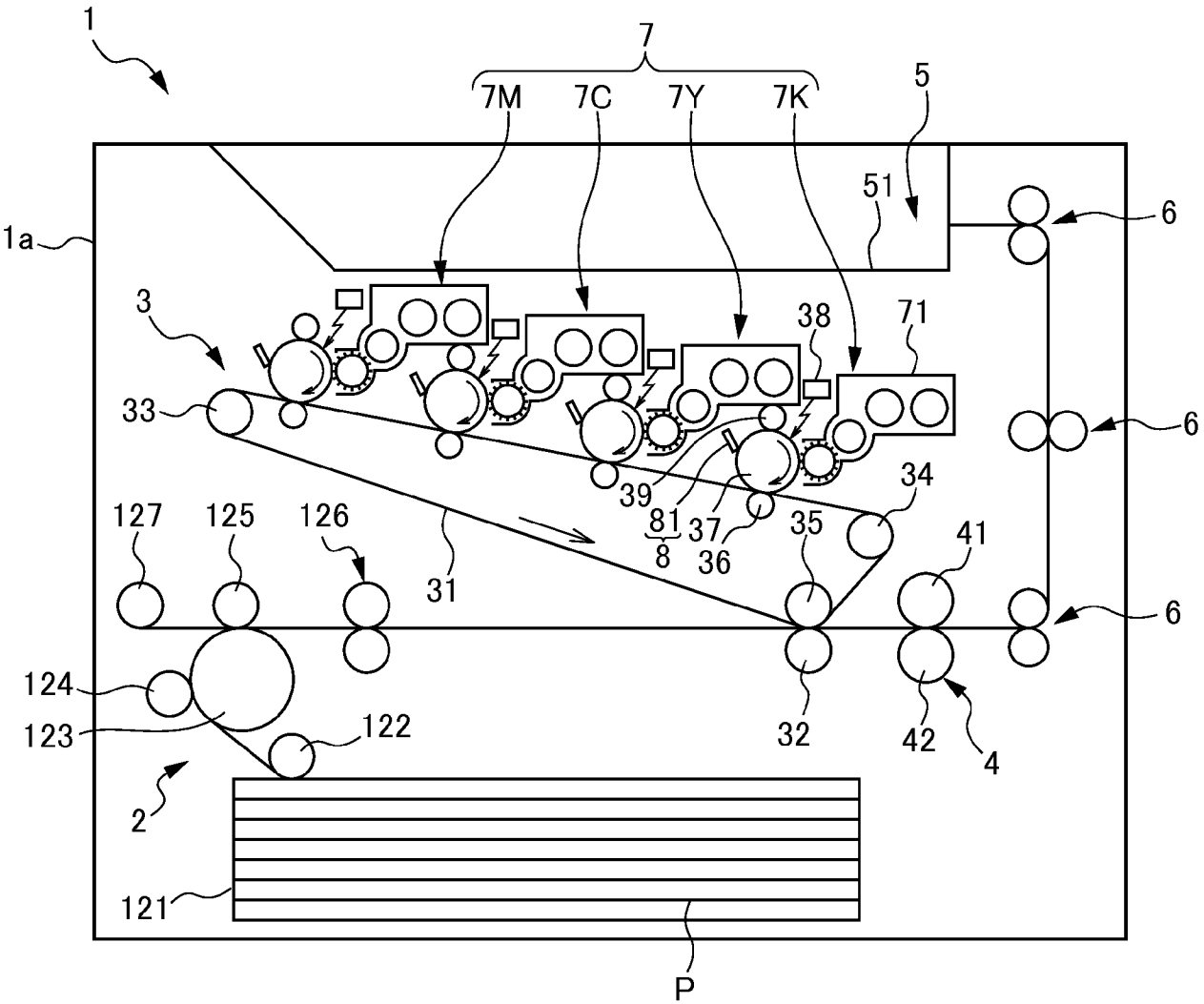
1
1a
3
33
5
51
6
6
6
7
7K
7Y
7C
7M
71
38
39
81
8
37
36
34
35
31
41
42
4
32
126
125
127
124
123
122
2
121
P

DEVELOPER FOR ELECTROSTATIC LATENT IMAGE DEVELOPMENT AND IMAGE FORMING METHOD

This application is based upon and claims the benefit of priority from the corresponding Japanese Patent Application No. 2011-163730 and 2012-127436, respectively filed in the Japan Patent Office on Jul. 26, 2011 and Jun. 4, 2012, the entire contents of which are incorporated herein by reference.

FIELD

The present disclosure relates to a developer for electrostatic latent image development, used for an image forming apparatus which is equipped with a latent image bearing member where a photosensitive layer composed of at least amorphous silicon is formed on a conductive substrate and a cleaning unit that has an elastic blade, and an image forming method using the image forming apparatus.

BACKGROUND

In electrophotography, generally, a latent image bearing member composed of a photoconductive light sensitive material body is charged by corona discharge etc., then a charged latent image bearing member is exposed by laser, LED, etc., and the resulting electrostatic latent image is developed and visualized using a developer such as a toner to form an image with high quality.

Heretofore, latent image bearing members equipped with a photosensitive layer composed of an organic photoconductor (OPC) have typically been used as the latent image bearing member used in the image forming method. However, in recent years, a latent image carrier unit equipped with a photosensitive layer composed of amorphous silicon has been investigated in response to the requirement to improve the durability of image forming apparatuses. Although the latent image bearing members are abraded through sliding or fractioning with materials to be printed or elastic blades described later, since the amorphous silicon shows a very excellent abrasion resistance, higher durability of image forming apparatuses may be achieved from the viewpoint of abrasion resistance of the latent image bearing members. Specifically, the reduction speed of film thickness of the amorphous silicon due to abrasion is no greater than 1/100 of that of organic photoconductors.

Therefore, in the image forming apparatuses having a positively chargeable latent image bearing member equipped with the photosensitive layer composed of amorphous silicon, the latent image carrier unit (photoconductor) can show a longer operating life, and thus the imaging cost per image may be reduced. From the viewpoint of such advantages, use of the latent image bearing member equipped with the photoconductive layer composed of amorphous silicon has been spreading.

In addition, when a toner has remained on a surface of the latent image bearing member equipped with the photosensitive layer composed of amorphous silicon after images of the toner are transferred on a surface of material such as papers to be printed, the toner is removed by a cleaning unit. In regards to the cleaning unit, those equipped with an elastic blade have been widely used since the configuration is simple due to a small number of moving parts and thus the image forming apparatus can be downsized.

In this way, the latent image bearing member equipped with the photosensitive layer composed of amorphous silicon and the cleaning unit equipped with the elastic blade are often used in combination in view of the respective advantages.

However, there is a defect in the latent image bearing member equipped with the photosensitive layer composed of amorphous silicon in that the friction coefficient at the surface of the latent image bearing member tends to increase under prolonged and continuous formation of images. When the friction coefficient has increased, in the image forming apparatuses having the combination of the latent image bearing member equipped with the photosensitive layer composed of amorphous silicon and the cleaning unit equipped with the elastic blade, there arise a problem in that curling of the elastic blade or image defects (called as "void") due to the resistance of toner particles to separate from the surface of the latent image bearing member tends to occur.

In order to solve the problems in the image forming apparatuses having the combination of the latent image bearing member equipped with the photosensitive layer composed of amorphous silicon and the cleaning unit equipped with the elastic blade, a method has been proposed in which a lubricant with a particle diameter of 1 μm or less is coated on the surface of the latent image bearing member by a lubricant supply means such as a brush.

However, in this method, the additional lubricant supply means such as a brush is necessary, and thus there are problems that downsizing of the image forming apparatuses is disturbed and also production cost of the image forming apparatuses is increased.

It may be envisaged that the lubricant is included into a developer containing a toner as the method to supply the lubricant to the surface of the latent image bearing member without the lubricant supply means. However, since fatty acid metal salts suited to lubricant particles are of negative charge, the charged amount of the toner is likely to decrease when the fatty acid metal salts are included into the developer containing a positively chargeable toner. Moreover, fine particles with a particle diameter of 1 μm or less tend to adhere to the surface of toners, therefore, when the positively chargeable toner and fine particles of fatty acid metal salts are used in combination, because a negatively charged toner generates, the toner is likely to scatter from development devices, and image defects such as fog tend to occur in the resulting images.

SUMMARY

The present disclosure has been made in view of the problems described above; and it is an object of the present disclosure to provide a developer for electrostatic latent image development containing a positively chargeable toner, in which when forming images by the image forming apparatuses having the combination of the latent image bearing member equipped with the photosensitive layer composed of amorphous silicon and the cleaning unit equipped with the elastic blade, the increase in friction coefficient at the surface of the latent image bearing member after continuously forming images for a long period can be suppressed, toners can be charged to a desired charged amount, and the toner scattering from development units or generation of image defects such as fog in the resulting images can be reduced by suppressing the generation of a reversely charged toner; and an image forming method using the developer for electrostatic latent image development.

The first aspect of the present disclosure is a developer for electrostatic latent image development used for an image forming apparatus which is equipped with a latent image bearing member where a photosensitive layer composed of at least amorphous silicon is formed on a conductive substrate and a cleaning unit that has an elastic blade, in which the developer includes a positively chargeable toner and a fatty acid metal salt, the fatty acid metal salt is a metal salt selected from the group consisting of zinc, calcium, and magnesium salts of fatty acids of 12 to 20 carbon atoms, and the fatty acid metal salt has a content of particles with a particle diameter of 3 μm or smaller of 20% by volume or less, and a content of particles with a particle diameter of 10 μm or larger of 5% by volume or less.

Another aspect of the present disclosure is an image forming method, for forming an image using a developer for electrostatic latent image development in an image forming apparatus which is equipped with a latent image bearing member where a photosensitive layer composed of at least amorphous silicon is formed on a conductive substrate and a cleaning unit that has an elastic blade, in which the developer includes a positively chargeable toner and a fatty acid metal salt, the fatty acid metal salt is a metal salt selected from the group consisting of zinc, calcium, and magnesium salts of fatty acids of 12 to 20 carbon atoms, and the fatty acid metal salt has a content of particles with a particle diameter of 3 μm or smaller of 20% by volume or less, and a content of particles with a particle diameter of 10 μm or larger of 5% by volume or less.

BRIEF DESCRIPTION OF THE DRAWINGS

FIG. 1 is a cross-section view which schematically shows a configuration of an image forming apparatus.

DETAILED DESCRIPTION OF EMBODIMENTS

Hereinafter, embodiments of the present disclosure are explained in detail, but the present disclosure is not limited to the embodiments below and may be carried out with appropriately making a change within the scope of the disclosure. In addition, repeated explanations are occasionally omitted as appropriate, but this does not limit the scope of the disclosure.

First Embodiment

The first embodiment of the present disclosure relates to a developer for electrostatic latent image development (hereinafter, also referred to as "developer"). The developer for electrostatic latent image development of the first embodiment is used in an image forming apparatus which is equipped with a latent image bearing member where a photosensitive layer composed of at least amorphous silicon is formed on a conductive substrate and a cleaning unit that has an elastic blade, and includes a positively chargeable toner (hereinafter, also referred to as "toner") and a certain type of fatty acid metal salt having a certain particle size distribution. Additionally, the developer for electrostatic latent image development of the present disclosure is used as a three component developer to which a carrier has been compounded, as needed.

Hereinafter, the developer of the first embodiment is explained with respect to positively chargeable toners, fatty acid metal salts, methods of producing the developer, and carriers used for three component developer in order.

Positively Chargeable Toner

The positively chargeable toner included in the developer for electrostatic latent image development of the present disclosure may be one appropriately selected from conventional various positively chargeable toners used heretofore for the development of electrostatic latent images without particular limitation thereto. The preferable toner included in the developer for electrostatic latent image development may be exemplified by a toner that contains a binder resin and a colorant, and optionally a charge control agent, a release agent, a magnetic powder, etc. The toner may also be treated on the surface with an external additive such as silica. Hereinafter, binder resins, colorants, charge control agents, release agents, magnetic powders, external additives, and methods for producing the toner are explained in order below.

(Binder Resin)

The binder resin included in the positively chargeable toner may be those conventionally used in toner production without particular limitation thereto. Specific examples of the binder resin include thermoplastic resins such as styrene resins, acrylic resins, styrene-acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins. Among these resins, styrene-acrylic resins and polyester resins are preferable in view of dispersibility of colorants in the toner, chargeability of the toner, and fixability on paper. Hereinafter, the styrene-acrylic resin and polyester resin are explained.

The styrene-acrylic resin is a copolymer of a styrene monomer and an acrylic monomer. Specific examples of the styrene monomer include styrene, α-methylstyrene, vinyl toluene, α-chlorostyrene, o-chlorostyrene, m-chlorostyrene, p-chlorostyrene, and p-ethylstyrene. Specific examples of the acrylic monomer include alkyl(meth)acrylates such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

The polyester resin may be those resulting from condensation polymerization or condensation copolymerization of an alcohol component and a carboxylic acid component. The components used for synthesizing polyester resins are exemplified by the alcohol components and carboxylic acid components below.

Specific examples of bivalent, trivalent or higher valent alcohols include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher valent alcohols such as sorbitol, 1,2,3,6-hexane tetrol, 1,4-sorbitane, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the bivalent, trivalent or higher valent carboxylic acids include bivalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, and malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. The bivalent, trivalent or higher valent carboxylic acids may be used as ester-generating derivatives such as acid halides, acid anhydrides, and lower alkyl esters. The term "lower alkyl" means an alkyl group of 1 to 6 carbon atoms.

When the binder resin is a polyester resin, the softening point of the polyester resin is preferably 80° C. to 150° C., more preferably 90° C. to 140° C.

The binder resin is preferably a thermoplastic resin in view of proper fixability, and the thermoplastic resin may be used by itself, and also the thermoplastic resin may be added with a cross-linking agent or a thermosetting resin. By way of introducing a partial cross-linked structure into the binder resin, preservation stability, morphological retention, durability, etc. may be improved without degrading the fixability.

Preferable examples of the thermosetting resins usable in combination with the thermoplastic resin are epoxy resins and isocyanate resins. Specific examples of the preferable thermosetting resins include bisphenol-A type epoxy resins, hydrogenated bisphenol-A type epoxy resins, novolac-type epoxy resins, polyalkylene ether-type epoxy resins, cyclic aliphatic-type epoxy resins, and cyanate resins. These thermosetting resins may be used in a combination of two or more.

The glass transition point (Tg) of the binder resin is preferably 50° C. to 65° C., more preferably 50° C. to 60° C. When the glass transition point of the binder resin is excessively low, the toner itself may agglomerate within development units of image forming apparatuses, or the toner itself may partially agglomerate during shipping in toner containers or storage toner containers in warehouses, for example, due to deterioration of preservation stability. When the glass transition point is excessively high, the toner is likely to adhere to the latent image bearing member due to a lower strength of the binder resin. Furthermore, when the glass transition point is excessively high, the fixability of the toner tends to degrade at lower temperatures.

Additionally, the glass transition point of the binder resin can be determined from a changing point of specific heat of the binder resin using a differential scanning calorimeter (DSC). More specifically, it can be determined by measuring an endothermic curve using a differential scanning calorimeter (DSC-6200, by Seiko Instruments Inc.) as the measuring device. Ten mg of a sample to be measured is put into an aluminum pan and an empty aluminum pan is used as a reference, and an endothermic curve is measured under the condition of a measuring temperature range of 25° C. to 200° C., a temperature-increase rate of 10° C./min, and ambient temperature and ambient humidity, then the glass transition point can be determined from the resulting endothermic curve.

(Colorant)

The colorant included in the toner may be conventional pigments or dyes depending on the color of the toner particles. Specific examples of appropriate colorants added to the toner include black pigments such as carbon black, acetylene black, lamp black, and aniline black; yellow pigments such as chrome yellow, zinc yellow, cadmium yellow, yellow iron oxide, mineral fast yellow, nickel titanium yellow, nables yellow, naphthol yellow S, hanza yellow G, hanza yellow 10G, benzizin yellow G, benzizin yellow GR, quinoline yellow lake, permanent yellow NCG, and turtrazin lake; orange pigments such as red chrome yellow, molybdenum orange, permanent orange GTR, pyrazolone orange, balcan orange, and indanthrene brilliant orange GK; red pigments such as iron oxide red, cadmium red, minium, cadmium mercury sulfate, permanent red 4R, lisol red, pyrazolone red, watching red calcium salt, lake red D, brilliant carmine 6B, eosine lake, rhodamine lake B, alizarin lake, and brilliant carmine 3B; violet pigments such as manganese violet, fast violet B, and methyl violet lake; blue pigments such as pigment blue 27, cobalt blue, alkali blue lake, Victoria blue partially chlorinated product, fast sky blue, and indanthrene blue BC; green pigments such as chrome green, chromium oxide, pigment green B, malachite green lake, and final yellow green G; white pigments such as zinc white, titanium dioxide, antimony white, and zinc sulfate; and extender pigments such as baryta powder, barium carbonate, clay, silica, white carbon, talc, and alumina white. These colorants may be used in a combination of two or more for the purpose of tailoring the toner to an intended hue.

The amount of the colorant used is not particularly limited providing that it is within a range that does not inhibit the purpose of the present disclosure. Specifically, the amount of the colorant used is preferably 1 to 10 parts by mass based on 100 parts by mass of the binder resin, more preferably 3 to 7 parts by mass.

(Release Agent)

The toner may contain a release agent for the purpose of improving the fixability and anti-offset property. The type of the release agent added to the toner is not particularly limited providing that it is within a range that does not inhibit the purpose of the present disclosure. The release agent is preferably a wax; and examples of the wax include polyethylene wax, polypropylene wax, fluorine resin wax, Fischer-Tropsch wax, paraffine wax, ester wax, Montan wax, and rice wax. These waxes may be used in a combination of two or more. The generation of offset or image smearing (smear around images generating upon rubbing the images) may be effectively inhibited in the resulting images by adding the release agent to the toner.

The amount of the release agent used is not particularly limited providing that it is within a range that does not inhibit the purpose of the present disclosure. The specific amount of the release agent used is preferably 1 to 5 parts by mass based on 100 parts by mass of total amount of the toner. When the amount of the release agent used is excessively small, the desired effect may not be obtained for inhibiting the generation of offset or image smearing in the resulting images, and when the amount of the release agent used is excessive large, the storage stability of the toner may be degraded due to the fusion of the toner itself.

Charge Control Agent

The charge control agent is used for the purpose of improving a charged level or a charge-increasing property which is an indicator of chargeability to a predetermined charged level within a short time, thereby obtaining a toner with excellent durability and stability. In the first embodiment, since the toner included in the developer is a positively chargeable toner, a positively chargeable charge control agent is used as the charge control agent.

The type of the positively chargeable charge control agent is not particularly limited providing that it is within a range that does not inhibit the purpose of the present disclosure, and the charge control agent may be appropriately selected from the positively chargeable charge control agents conventionally used for toners. Specific examples of the positively chargeable charge control agent include azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine FastRed FC, azine FastRed 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amine; alkylamido; quaternary ammonium salts such as benzylmethylhexyldecyl ammonium, and decyltrimethylammonium chloride; and the like. Among these positively chargeable charge control agents, nigrosine compounds are particularly preferable since a more rapid charge-increasing property may be obtained. These positively chargeable charge control agents may be used in a combination of two or more.

In addition, resins having a quaternary ammonium salt, a carboxylic acid salt, or a carboxyl group as a functional group may be used as the positively chargeable charge control agent. More specifically, styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxylic group, acrylic resins having a carboxylic group, styrene-acrylic resins having a carboxylic group, and polyester resins having a carboxylic group may be exemplified. The molecular weight of these resins is not particularly limited providing that it is within a range that does not inhibit the purpose of the present disclosure; and oligomers or polymers may also be allowable.

Among the resins usable as the positively chargeable charge control agent, styrene-acrylic resins having a quaternary ammonium salt as the functional group are more preferable since the charged amount may be easily controlled within an intended range. In regards to the styrene-acrylic resins having a quaternary ammonium salt as the functional group, specific examples of acrylic comonomers preferably copolymerized with a styrene unit may be exemplified by (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Additionally, the units derived from dialkylamino alkyl (meth)acrylates, dialkyl(meth)acrylamides, or dialkylamino alkyl(meth)acrylamides through a quaternizing step may be used as the quaternary ammonium salt. Specific examples of dialkylamino alkyl(meth)acrylate include dimethylamino ethyl(meth)acrylate, diethylamino ethyl(meth)acrylate, dipropylamino ethyl(meth)acrylate, and dibutylamino ethyl (meth)acrylate; a specific example of dialkyl(meth)acrylamide is dimethyl methacrylamide; and a specific example of dialkylamino alkyl(meth)acrylamide is dimethylamino propylmethacrylamide. Additionally, hydroxyl group-containing polymerizable monomers such as hydroxy ethyl(meth) acrylate, hydroxy propyl(meth)acrylate, 2-hydroxy butyl (meth)acrylate, and N-methylol(meth)acrylamide may be used in combination at the time of polymerization.

The amount of the charge control agent used is not particularly limited providing that it is within a range that does not inhibit the purpose of the present disclosure. Typically, the amount of the charge control agent used is preferably 1.5 to 15 parts by mass based on 100 parts by mass of the total amount of the toner, more preferably 2.0 to 8.0 parts by mass, and most preferably 3.0 to 7.0 parts by mass. When the amount of the charge control agent used is excessively small, it becomes difficult to stably charge the toner; therefore, the image density of the resulting images may be lower than a desired value or it becomes difficult to maintain the image density of the resulting images for a long period. Besides, in such cases, it becomes difficult to uniformly disperse the charge control agent; consequently, image fog in the resulting images or pollution due to the toner at the latent image bearing member is likely to occur. When the amount of the charge control agent used is excessively large, an inferior charge under high temperature and high humidity, image defects in the resulting images, or pollution due to the toner at the latent image bearing member tends to occur due to poor environmental resistance.

(Magnetic Powder)

The positively chargeable toner may be a magnetic toner containing a magnetic powder in the binder resin. The type of the magnetic powder compounded in the binder resin is not particularly limited providing that it is within a range that does not inhibit the purpose of the present disclosure. Specific examples of the preferable magnetic powder include oxidized iron such as ferrite and magnetite, ferromagnetic metals such as of cobalt and nickel, alloys of iron and/or ferromagnetic metals, compounds of iron and/or ferromagnetic metals, ferromagnetic alloys via ferromagnetizing treatment like heat-treatment, and chromium dioxide.

The particle diameter of the magnetic powder is not particularly limited providing that it is within a range that does not inhibit the purpose of the present disclosure. Specifically, the particle diameter of the magnetic powder is 0.1 to 1.0 μm, more preferably 0.1 to 0.5 μm. The magnetic powder within this particle diameter range may be easily dispersed into the binder resin.

In order to improve the dispersibility of the magnetic powder in the binder resin, those surface-treated by a surface treatment agent such as titanium coupling agents and silane coupling agents may be used.

The amount of the magnetic powder used is not particularly limited providing that it is within a range that does not inhibit the purpose of the present disclosure. The specific amount of the magnetic powder used is preferably 20 to 60 parts by mass based on 100 parts by mass of the total amount of the toner, more preferably 30 to 50 parts by mass. When the amount of the magnetic powder used is excessively large, the image density of the resulting images may not be maintained or the fixability may be remarkably degraded; and when the amount of the magnetic powder used is excessively small, fog tends to be generated in the resulting images or it becomes difficult to maintain the image density of the resulting images in cases of printing for a long period. Additionally, when the toner is used as a three component developer described later, the amount of the magnetic powder used is preferably 20 parts by mass or less based on 100 parts by mass of the total amount of the toner, more preferably 15 parts by mass or less.

(External Additive)

The positively chargeable toner may be provided with an external additive on the surface of the toner in order to improve the flowability, storage stability, cleaning ability, etc.

The type of the external additive is not particularly limited providing that it is within a range that does not inhibit the purpose of the present disclosure, and the external additive may be appropriately selected from those conventionally used for toners. Specific examples of the external additive include silica and metal oxides such as alumina, titanium oxide, magnesium oxide, zinc oxide, strontium titanate, and barium titanate. These external additives may be used in a combination of two or more.

The particle diameter of the external additive is not particularly limited providing that it is within a range that does not inhibit the purpose of the present disclosure; typically, the range of 0.01 to 1.0 μm is preferable.

The value of volume specific resistance of the external additive may be adjusted by forming a coating layer consisting of tin oxide and antimony oxide on the surface of the external additive and changing a thickness of the coating layer or a ratio of tin oxide to antimony oxide.

The amount of the external additive used is not particularly limited provided that it is within a range that does not inhibit the purpose of the present disclosure. Typically, the amount of the external additive used is preferably 0.1 to 10 parts by mass and more preferably 0.2 to 5 parts by mass based on 100 parts by mass of the toner particles before the treatment by the external additive. When the external additive is used within this range, the toner excellent in flowability, storage stability, and cleaning ability may be easily obtained.

(Method of Preparing Positively Chargeable Toner)

The method of preparing the positively chargeable toner is not particularly limited provided that the components such as the colorant, the charge control agent, the release agent, the magnetic powder, etc. can be successfully dispersed into the binder resin; and the method may be appropriately selected from conventional toner production methods. A preferable production method may be exemplified by the steps of mixing the components such as the binder resin, the colorant, the charge control agent, the release agent, the magnetic powder, etc., then melting and kneading the resulting mixed material, followed by pulverizing and classifying the resulting kneaded material. The melting/kneading device for producing the positively chargeable toner may be appropriately selected from those used for melting/kneading thermoplastic resins without particular limitation thereto. Specific examples of the melting/kneading device include single or twin screw extruders. The average particle diameter of the pulverized/classified toner, which is not particularly limited providing that it is within a range that does not inhibit the purpose of the present disclosure, is preferably 5 to 10 μm in general.

The toner obtained in this way may be further surface-treated with an external additive as required. Here, the particles before this external treatment are referred to as "toner base particles". The process for treating the toner by the external additive is not particularly limited thereto and may be appropriately selected from conventional treatment processes by external additives. Specifically, treatment conditions are controlled such that particles of the external additive are not embedded into toner base particles, then the treatment of the external additive is carried out using a mixer such as Henschel mixer and Nauter mixer.

Fatty Acid Metal Salt

The developer for electrostatic latent image development in the first embodiment includes a metal salt selected from the group consisting of zinc, calcium, and magnesium salts of fatty acids of 12 to 20 carbon atoms as the fatty acid metal salt. The structure of the fatty acid forming the fatty acid metal salt is not particularly limited providing that it is within a range that does not inhibit the purpose of the present disclosure; that is, linear fatty acids, branched fatty acids, saturated fatty acids, and unsaturated fatty acids are allowable. In regards to the fatty acid of the fatty acid metal salt, linear saturated fatty acids are more preferable in view of easy availability and excellent storage stability.

The fatty acid of the fatty acid metal salt is of 12 to 20 carbon atoms. When the number of carbon atoms in the fatty acid is excessively small, the molecular weight of the fatty acid metal salt becomes lower, thus the number of molecules of the fatty acid metal salt per unit weight of the fatty acid metal salt becomes higher. Consequently, the charged amount of the toner tends to decrease or a reversely charged toner tends to be generated. When the number of carbon atoms in the fatty acid is excessively large, an intended effect may not be obtainable for suppressing the increase in the friction coefficient at the surface of the latent image bearing member. Among the fatty acids of the fatty acid metal salts, stearic acid, which is a linear saturated fatty acid of 18 carbon atoms, is preferable in view of effectively suppressing the increase in the friction coefficient at the surface of the latent image bearing member and the generation of a reversely charged toner.

Furthermore, in regards to the fatty acid metal salt included in the developer, the content of the particles with a particle diameter of 3 μm or smaller is 20% by volume or less, and the content of the particles with a particle diameter of 10 μm or larger is 5% by volume or less. In such a fatty acid metal salt, the content of fine particles and coarse particles is relatively small, and their particle diameters are similar to the particle diameters of the toner. In the developer in the first embodiment, the fatty acid metal salt having the particle size distribution described above, and with a larger content of the particles having the sizes similar to those of the toner is used; consequently, the fatty acid metal salt shows almost no adhesion to the toner surface. For this reason, almost all of the fatty acid metal salt is freely separated from the toner in the developer, and thus a desired amount of the fatty acid metal salt can be supplied together with the toner to the surface of the latent image bearing member, thereby resulting in easy suppression of an increase in the friction coefficient at the surface of the latent image bearing member.

The volume average particle diameter of the fatty acid metal salt is not particularly limited as long as the content of the particles with a particle diameter of 3 μm or smaller and the content of the particles with a particle diameter of 10 μm or larger satisfy the predetermined values. Preferably, the volume average particle diameter of the fatty acid metal salt is 4 to 8 μm.

Here, when the particles of the fatty acid metal salt are coarse, the coarse particles of the fatty acid metal salt easily drop in a development device together with the toner, and thus the toner is likely to scatter outside the development device. However, since the developer in the first embodiment includes the fatty acid metal salt in which the content of the particles with a particle diameter of 10 μm or larger is 5% by volume or less, the toner scattering from the development unit is unlikely to occur.

The process to adjust the volume average particle diameter and the particle size distribution of the fatty acid metal salt is not particularly limited thereto. Specifically, by way of appropriately changing the conditions in pulverizing and classifying steps when pulverizing and classifying the fatty acid metal salt using conventional devices, the volume average particle diameter and the particle size distribution of the fatty acid metal salt may be adjusted. For example, an air flow type pulverizer as a pulverizing device and an air flow classifier as a classifying device may be used in order to prepare the fatty acid metal salt for which the volume average particle diameter and the particle size distribution should be adjusted.

Among the fatty acid metal salts, zinc salts or calcium salts are more preferable since fogging may be easily suppressed when printing under an environment of high temperature and high humidity. When magnesium salts are used, the magnesium salts may adhere to carriers, therefore it may be difficult to charge the toner to a desired charged amount, thereby somewhat generating the fog when printed under an environment of high temperature and high humidity. Additionally, among the fatty acid metal salts, zinc salts are particularly preferable since the zinc salts may particularly suppress the increase in the friction coefficient at the surface of the latent image bearing member.

Specific examples of the fatty acid metal salt compounded into the developer include zinc laurate, calcium laurate, magnesium laurate, zinc myristate, calcium myristate, magnesium myristate, zinc palmitate, calcium palmitate, magnesium palmitate, zinc stearate, calcium stearate, magnesium stearate, zinc arachidate, calcium arachidate, magnesium arachidate, etc.

The content of the fatty acid metal salt in the developer, which is not particularly limited provided that it is within a range that does not inhibit the purpose of the present disclosure, is preferably 0.01 to 0.5 parts by mass based on 100 parts by mass of the positively chargeable toner. By compounding the fatty acid metal salt in this content, the suppression may be facilitated with respect to the increase in the friction coefficient at the surface of the latent image bearing member and the generation of a reversely charged toner.

Method of Preparing Developer for Electrostatic Latent Image Development

The method of preparing the developer for electrostatic latent image development of the first embodiment is not particularly limited as long as the positively chargeable toner and the fatty acid metal salt can be uniformly mixed. The method of mixing the positively chargeable toner and the fatty acid metal salt may be exemplified by processes using mixing devices such as a Henschel mixer.

From the viewpoint that adhesion of fine powders of the fatty acid metal salt to the surface of positively chargeable toners can be suppressed, the process of mixing the toner bearing the external additive on its surface and the fatty acid metal salt is preferable as the method of preparing the developer. In addition, from the view point that the external treatment and the mixing of the fatty acid metal salt and the toner can be carried out at the same time and thus preparation operations of the developer can be simplified, the process of adding the fatty acid metal salt to the mixing device together with the external additive described above when the external additive is made to adhere on the surface of toner base particles is preferable as the method of preparing the developer.

Carrier

For the developer for electrostatic latent image development of the first embodiment, mixture of the positively chargeable toner and the fatty acid metal salt with a desired carrier may be used as a three component developer. The three component developer may be handled similarly to two component developers which are widely used for electrostatic latent image development and consist of toners and carriers. In a case of preparing the three component developer, a magnetic carrier is preferably used.

The preferable carrier for making the developer into the three component developer may be exemplified by carriers in which a carrier core coated with a resin. Specific examples of the carrier core include particles of iron, oxidized iron, reduced iron, magnetite, copper, silicon steel, ferrite, nickel, and cobalt; alloy particles of these materials and manganese, zinc, aluminum, etc.; particles of iron-nickel alloy, iron-cobalt alloy, etc.; ceramic particles of titanium oxide, aluminum oxide, copper oxide, magnesium oxide, lead oxide, zirconium oxide, silicon carbide, magnesium titanate, barium titanate, lithium titanate, lead titanate, lead zirconate, lithium niobate, etc.; particles of higher permittivity materials such as ammonium dihydrogen phosphate, potassium dihydrogen phosphate, and Rochelle salts; resin carriers in which these magnetic particles are dispersed in resins; and the like.

Specific examples of the resin, which coats the carrier core, include (meth)acrylic polymer, styrene polymer, styrene-(meth)acrylic copolymer, olefin polymer (polyethylene, chlorinated polyethylene, polypropylene, etc.), polyvinyl chloride, polyvinyl acetate, polycarbonate, cellulose resins, polyester resins, unsaturated polyester resins, polyamide resins, polyurethane resins, epoxy resins, silicone resins, fluorocarbon resins (polytetrafluoroethylene, polychlorotrifluoroethylene, polyvinylidene fluoride, etc.), phenol resins, xylene resins, diallyl phthalate resins, polyacetal resins, amino resins, etc. These resins may be used in a combination of two or more.

The particle diameter of the carrier, which is not particularly limited providing that it is within a range that does not inhibit the purpose of the present disclosure, is preferably 20 to 120 μm and more preferably 25 to 80 μm as a particle diameter measured by an electron microscope.

The apparent density of the carrier is not particularly limited providing that it is within a range that does not inhibit the purpose of the present disclosure. Typically, the apparent density of the carrier, which depends on a composition and surface structure of the carrier, is preferably 2.0 to 2.5 g/cm$^3$.

When the toner for electrostatic image development is used as the three component developer, the total content of the toner and the fatty acid metal salt is preferably 1% to 20% by mass based on the mass of the three component developer, more preferably 3% to 15% by mass. By way of adjusting the total content of the toner and the fatty acid metal salt in the three component developer within this range, a proper image density may be maintained in the resulting images, and the pollution inside image forming apparatuses or the adhesion of the toner to transfer papers, etc. may be reduced by suppressing the scattering of the toner from development units.

When the developer contains the carrier, the fatty acid metal salt may be mixed to the mixture of the positively chargeable toner and the carrier, or the carrier may be further mixed to the developer where the positively chargeable toner and the carrier have been mixed.

By virtue of the developer for electrostatic latent image development in the first embodiment prepared by the materials and processes described above, when forming images by the image forming apparatuses having the combination of the latent image bearing member equipped with the photosensitive layer composed of amorphous silicon and the cleaning unit equipped with the elastic blade, the increase in friction coefficient at the surface of the latent image bearing member after continuously forming images for a long period can be suppressed, the toner can be charged to a desired charged amount, and the toner scattering from development units or generation of image defects such as fog in the resulting images can be reduced by suppressing the generation of a reversely charged toner.

Second Embodiment

The second embodiment of the present disclosure relates to an image forming method in which an image is formed using the developer for electrostatic latent image development of the first embodiment in the image forming apparatus which is equipped with a latent image bearing member where a photosensitive layer composed of at least amorphous silicon is formed on a conductive substrate and a cleaning unit that has an elastic blade. Hereinafter, the image forming method in the second embodiment of the present disclosure is explained.

The image forming apparatus, which is used in the image forming method of the second embodiment, is not particularly limited as long as the image forming apparatus it is equipped with a latent image bearing member where a photosensitive layer composed of at least amorphous silicon is formed on a conductive substrate and a cleaning unit that has an elastic blade. More preferably, the image forming apparatus is equipped with a latent image bearing member where the distance from the surface of the conductive substrate at the side of the photosensitive layer to the outermost surface of the latent image bearing member is 30 μm or less, since images with a higher resolution may be obtained compared to the cases where the photosensitive layer composed of amorphous silicon is thicker.

The image forming apparatus, which is used in the image forming method of the second embodiment, is preferably a tandem-type color image forming apparatus which uses two or more colored developers as described later. Hereinafter, the image forming method using the tandem-type color image forming apparatus is explained.

In this connection, the tandem-type color image forming apparatus explained below is equipped with two or more latent image bearing members which are arranged in parallel in order to form a toner image by positively chargeable toners included in respective developers with different colors on the surfaces of the two or more latent image bearing members, and two or more development units with development rollers which are disposed oppositely to the respective latent image bearing members, which bear the toner on the surface thereof and convey the toner, and which supply the conveyed toner respectively to the surfaces of the latent image bearing members; in which the development units supply the developer for electrostatic latent image development of the present disclosure to the latent image bearing members.

FIG. 1 is a schematic view that shows a configuration of an appropriate image forming apparatus used in the image forming method of the second embodiment. Here, the image forming apparatus is explained with reference to a color printer 1 as an example.

The color printer 1 has a box-type device body 1*a* as shown in FIG. 1. A paper feed unit 2 that feeds a paper P, an image forming unit 3 that transfers a toner image based on image data, etc. on the paper P while conveying the paper P fed from the paper feed unit 2, and a fixing unit 4 that applies a fixing treatment to fix an unfixed toner image transferred on the paper P by the image forming unit 3 to the paper P are provided in the device body 1*a*. A paper discharge unit 5 that discharges the paper P applied with the fixing treatment by the fixing unit 4 is further provided at an upper side of the device body 1*a*.

The paper feed unit 2 is equipped with a paper feed cassette 121, a pick-up roller 122, paper feed rollers 123, 124, 125, and a pair of resist rollers 126. The paper feed cassette 121 is provided detachably to the device body 1*a* and accommodates the paper P. The pick-up roller 122 is provided at a position of the upper left of the paper feed cassette 121 as shown in FIG. 1 to pick up the paper P accommodated in the paper feed cassette 121 one by one. The paper feed rollers 123, 124, 125 send the paper P picked up by the pick-up roller 122 to a paper conveying route. The pair of resist rollers 126 direct the paper P sent to the paper conveying route by the paper feed rollers 123, 124, 125 to temporally wait and feed the paper P to the image forming unit 3 at a predetermined timing.

The paper feed unit 2 is further equipped with a manual feed tray (not shown) attached at left side of the device body 1*a* shown in FIG. 1 and a pick-up roller 127. The pick-up roller 127 picks up the paper P disposed on the manual feed tray. The paper P picked up by the pick-up roller 127 is sent to a paper conveying route by the paper feed rollers 123, 125 and fed to the image forming unit 3 by the pair of resist rollers 126 at a predetermined timing.

The image forming unit 3 is equipped with an image forming part 7, an intermediate transfer belt 31 to which a toner image based on image data telephotographed from computers etc. is primarily transferred on its surface (contact side) by the image forming part 7, and a secondary transfer roller 32 that secondarily transfers the toner image on the intermediate transfer belt 31 to the paper P sent from the paper feed cassette 121.

The image forming part 7 is equipped with a black unit 7K, a yellow unit 7Y, a cyan unit 7C, and a magenta unit 7M which are disposed from an upper stream side (right side in FIG. 1) to a downstream side in series along the moving direction of the intermediate transfer belt 31. In each of the units 7K, 7Y, 7C, and 7M, a drum-shaped latent image bearing member 37 as an image bearing body is disposed at each central position thereof rotatably along the arrow direction (clockwise direction). Furthermore, a charging unit 39, an exposure unit 38, a development unit 71, a cleaning unit 8, a neutralization device, etc. are disposed around each latent image carrier unit 37 in series from an upper stream side of the rotating direction of the latent image bearing member 37.

The charging unit 39 uniformly charges the circumference of the latent image bearing member 37 which is being rotated in the arrow direction. The charging unit 39 is not particularly limited as long as it can uniformly charge the circumference of the latent image bearing member 37 and may be of non-contact or contact type. Specific examples of the charging unit include corona-charging devices, charging rollers, charging brushes, etc.

The surface potential (charged potential) of the latent image bearing member 37 is not particularly limited providing that it is within a range that does not inhibit the purpose of the present disclosure. Considering the balance between the developing property and the charging capacity of the latent image carrier unit 37, the surface potential is preferably +200 V to +500 V, more preferably +200 V to +300 V. When the surface potential is excessively low, the development field becomes insufficient and thus it becomes difficult to assure the image density of the resulting images. When the surface potential is excessively high, problems such as insufficient charging capacity, insulation breakdown of the latent image bearing member 37, they are depend on a thickness of the photosensitive layer, and an increase of the amount of generated ozone are likely to occur.

In the latent image bearing member 37, a photosensitive layer composed of amorphous silicon is formed on a drum-shaped conductive substrate. The photosensitive layer composed of amorphous silicon may be formed by vapor phase growth processes such as glow discharge decomposition process, sputtering process, ECR process, and vapor deposition process, for example. When the photosensitive layer composed of amorphous silicon is formed, H or halogen elements may be included into the photosensitive layer. For the purpose of tailoring the properties of the photosensitive layer, elements such as C, N, and O or Group 13 or 15 elements of the Periodic table (long-form type) may also be included into the photosensitive layer.

The material to construct the photosensitive layer composed of amorphous silicon is not particularly limited as long as it is amorphous silicon. Preferable materials of the amorphous silicon may be exemplified by amorphous Si, amorphous SiC, amorphous SiO, amorphous SiON, etc. Among these materials of the amorphous silicon, amorphous SiC is more preferable because of a higher resistance and excellence in charging properties, abrasion resistance, and environment resistance. Further, when the amorphous SiC is used as the material of amorphous silicon, amorphous $Si_{(1-X)}C_X$ ($0.3 \leq X < 1$) is preferable, and $Si_{(1-X)}C_X$ ($0.5 \leq X \leq 0.95$) is more preferable. The amorphous SiC of this composition exhibits a resistance value as high as $10^{12}$ to $10^{13}$ Ω·cm and thus can suppress the flow of latent image charge of the latent image bearing member 37, thereby obtaining the latent image bearing member 37 excellent in the capacity to maintain electrostatic latent images. Furthermore, by way of using the amorphous SiC of this composition, the latent image carrier unit 37 excellent in humidity resistance can be obtained.

The photosensitive layer may be formed on a carrier inhibition layer formed on the conductive substrate. A surface protection layer may be provided on the surface of the photosensitive layer. The latent image bearing member 37, which is prepared as a lamination of the conductive substrate, the carrier inhibition layer, the photosensitive layer, and the surface protection layer in order, is particularly preferably used.

When the surface protection layer is provided, the surface protection layer can prevent the formation of oxide films which tend to adsorb corona products, water molecules, etc. at the surface of the photosensitive layer composed of amorphous silicon during the discharge by the charging unit 39. Furthermore, by way of providing the surface protection layer, the improvement in a dielectric strength voltage and the improvement in an abrasion resistance during repeated usage of the latent image bearing member 37 may be attained. The material of the surface protection layer may be exemplified by inorganic insulating materials such as amorphous SiC, amorphous SiO, amorphous SiN, amorphous SiON, and amorphous SiCON.

The film thickness of the surface protection layer, which is not particularly limited providing that it is within a range that does not inhibit the purpose of the present disclosure, is preferably 20,000 Å or less, more preferably 5,000 to 15,000 Å. By way of adjusting the film thickness of the surface protection layer within this range, the latent image bearing member 37 far from degradation of its voltage resistance performance may be efficiently produced.

When the carrier inhibition layer is provided, the improvement in an image density of the resulting images and the reduction in background fog may be attained by way of increasing an electrostatic contrast between exposed portions and unexposed portions by inhibiting the injection of carriers into the photosensitive layer composed of amorphous silicon during development. The example of the carrier inhibition layer may be exemplified by inorganic insulating materials such as amorphous SiC, amorphous SiO, amorphous SiN, amorphous SiON, and amorphous SiCON and organic insulating materials such as polyethylene terephathalate, Parylene (trademark), polytetrafluoroethylene, polyimide, fluorinated polyethylene propylene, polyurethane, epoxy resin, polyester, polycarbonate, and cellulose acetate resin.

The film thickness of the carrier inhibition layer, which is not particularly limited providing that it is within a range that does not inhibit the purpose of the present disclosure, is preferably 0.01 to 5 μm, more preferably 0.1 to 3 μm. When the carrier inhibition layer is excessively thin, its desired carrier inhibition effect may not be obtained, and when the carrier inhibition layer is excessively thick, a longer time may be necessary to form the film and thus the productivity of the latent image bearing member 37 may be lowered.

In the latent image bearing member 37, the distance from the surface of the conductive substrate at the side of the photosensitive layer to the outermost surface of the latent image bearing member 37, which is not particularly limited, is preferably 30 μm or less from the viewpoint that production cost of the latent image bearing member 37 may be reduced and images excellent in resolution may be obtained. Here, the outermost surface of the latent image bearing member 37 is the surface of the surface protection layer when the surface protection layer is formed or the surface of the photosensitive layer when the surface protection layer is not formed. Additionally, the distance from the surface of the conductive substrate at the side of the photosensitive layer to the outermost surface of the latent image bering member 37 is the total thickness of the carrier inhibition layer, the photosensitive layer, and the surface protection layer.

In the latent image bearing member 37, the lower limit of the distance from the surface of the conductive substrate at the side of the photosensitive layer to the outermost surface of the latent image bearing member 37, which is not particularly limited providing that it is within a range that does not inhibit the purpose of the present disclosure, is preferably 10 μm or more. When the distance is excessively short, the charging property of the latent image bearing member 37 may be insufficient, and an interference pattern may generate in a half pattern due to irregular reflection of laser light used for exposure.

The exposure unit 38 is a so-called laser scanning unit where laser light is irradiated based on image data input from a personal computer (PC) as a higher-level device to the circumference of the latent image bearing member 37 uniformly charged by the charging unit 39, and an electrostatic latent image is formed on the latent image bearing member 37 based on the image data. From the development unit 71, the developer of the first embodiment containing the positively chargeable toner and the fatty acid metal salt is supplied to the circumference of the latent image bearing member 37 where the electrostatic latent image has been formed, thereby a toner image based on image data is formed while suppressing the increase in friction coefficient at the surface of the latent image bearing member 37. The configuration of the development unit 71 is appropriately changed depending on the type of developers and development processes. The toner image formed on the circumference of the latent image bearing member 37 by the development unit 71 is primarily transferred to the intermediate transfer belt 31.

After the primary transfer of the toner image to the intermediate transfer belt 31 is completed, the toner remaining on the circumference of the latent image bearing member 37 is cleaned by the cleaning unit 8. The cleaning unit 8 is equipped with the elastic blade 81 and removes the toner remaining on the circumference of the latent image bearing member 37 by the elastic blade 81. The elastic blade is formed from urethane rubbers or ethylene-propylene rubbers. When the developer of the first embodiment is used, the increase in friction coefficient at the surface of the latent image bearing member may be suppressed, thereby curling of the elastic blade and image defects such as void may be suppressed.

The neutralization device eliminates the charge at the circumference of the latent image bearing member 37 after the primary transfer. The circumference of the latent image bearing member 37, which has been subjected to the cleaning treatment by the cleaning unit 8 and the neutralization device, proceeds to the charging unit 39 for fresh charging treatment and is subjected to the fresh charging treatment.

The intermediate transfer belt 31 is an endless belt-shaped rotator and is tensioned over a plurality of rollers such as a driving roller 33, a driven roller 34, a backup roller 35, and primary transfer rollers 36 such that its surface side (contact surface) contacts the circumferences of the latent image bearing members 37. Furthermore, the intermediate transfer belt 31 is configured such that the intermediate transfer belt 31 rotates endlessly by two or more rollers under the condition of being pressed toward the latent image bearing members 37 by the primary transfer rollers 36 disposed oppositely to the latent image bearing members 37. The driving roller 33 is rotatably driven by a driving source such as a stepping motor (not shown) and provides the intermediate transfer belt 31 with a driving force for endless rotation. The driven roller 34, the backup roller 35, and the primary transfer rollers 36 are disposed rotatably and driven to rotate with the endless rotation of the intermediate transfer belt 31 by the driving roller 33. The rollers 34, 35, 36 are driven to rotate with the drive rotation of the driving roller 33 through the intermediate transfer belt 31 and also support the intermediate transfer belt 31.

The primary transfer roller 36 applies a negative-polarity primary transfer bias to the intermediate transfer belt 31. Thereby, the toner images formed on the latent image bearing members 37 are transferred in order (primary transfer) between each latent image bearing member 37 and each primary transfer roller 36 in a condition overprinting on the intermediate transfer belt 31 that is running around along the arrow direction (counterclockwise) by driving action of the driving roller 33.

The secondary transfer roller 32 applies a negative-polarity secondary transfer bias to the paper P. Thereby, the toner images primarily transferred on the intermediate transfer belt 31 are secondarily transferred on the paper P between the secondary transfer roller 32 and the backup roller 35; consequently, a color transfer image (unfixed toner image) is transferred on the paper P.

The fixing unit 4 applies a fixing treatment to the transfer image transferred on the paper P by the image forming unit 3 and is equipped with a heating roller 41 heated by an energizing heater and a pressure roller 42 which is disposed oppositely to the heating roller 41 and of which the circumference is urged to contact the circumference of the heating roller 41.

Then, the transfer image, which has been transferred on the paper P by the secondary transfer roller 22 in the image forming unit 3, is fixed on the paper P by the fixing treatment of heating and pressing while the paper P is passing between the heating roller 41 and the pressure roller 42. Then, the fixing-treated paper P is discharged to the paper discharge unit 5. Furthermore, in the color printer 1 of the embodiment, two or more pairs of convey rollers 6 are placed at appropriate positions between the fixing unit 4 and the paper discharge unit 5.

The paper discharge unit 5 is formed by making a concave area at the top of the device body 1 of the color printer 1, and a discharged paper tray 51 to receive the discharged paper P is formed at the bottom of the concave area.

The color printer 1 forms an image on the paper by actions for forming the image described above. Here, when the development is carried out using the developer for electrostatic latent image development of the first embodiment in the tandem-type image forming apparatus with the configuration described, even when the image forming apparatus is equipped with the elastic blade and the latent image bearing member 37 where the photosensitive layer composed of at least amorphous silicon is formed on a conductive substrate, the increase in friction coefficient at the surface of the latent image bearing member after continuously forming images for a long period can be suppressed, toners can be charged to a desired charged amount, and the toner scattering from development units or generation of image defects such as fog in the resulting images can be reduced by suppressing the generation of a reversely charged toner.

EXAMPLES

The present disclosure is explained more specifically with reference to examples below. In addition, the present disclosure is not limited to the examples.

Preparation Example 1

Preparation of Particles of Fatty Acid Metal Salt

Zinc stearate (II) (SZ-TF, by Sakai Chemical Industry Co., volume average particle diameter: 18 μm), calcium stearate (calcium stearate FI, by NOF Co., volume average particle diameter: 12.5 μm), zinc palmitate (II) (by Mitsuwa Chemicals Co.), zinc myristate (II) (by Mitsuwa Chemicals Co.), or magnesium stearate (by Taihei Chemical Industrial Co.) was pulverized by a jet mill (Model I ultrasonic jet mill, by Nippon Pneumatic Mfg. Co.), and the resulting pulverized material was classified by an elbow-jet (Model EJ-LABO, by Nittetsu Mining Co.). The conditions of pulverizing and classifying were appropriately set and the fatty acid metal salts A to H of Table 1 were prepared. The fatty acid metal salts A to H were measured for a particle size distribution by a particle size measuring apparatus (Multisizer 3, by Beckman Coulter Inc.) to determine a volume average particle diameter, a content (volume %) of particles with a particle diameter of 3 μm or smaller, and a content (volume %) of particles with a particle diameter of 10 μm or larger. The volume average particle diameter, the content (volume %) of particles with a particle diameter of 3 μm or smaller, and the content (volume %) of particles with a particle diameter of 10 μm or larger of the fatty acid metal salts A to H are shown in Table 1.

TABLE 1

| Fatty acid metal salt | Type | Volume average particle diameter (μm) | Content of particles: Particle diameter: 3 μm or smaller (volume %) | Content of particles: Particle diameter: 10 μm or larger (volume %) |
|---|---|---|---|---|
| A | Zinc stearate | 6.1 | 10.3 | 3.4 |
| B | Zinc stearate | 4.3 | 19.3 | 1.2 |
| C | Zinc stearate | 7.9 | 7.8 | 4.9 |
| D | Calcium stearate | 6.2 | 12.4 | 2.3 |
| E | Zinc stearate | 2.4 | 25.6 | 0.5 |
| F | Zinc stearate | 8.7 | 4.2 | 10.2 |
| G | Zinc palmitate | 6.3 | 13.6 | 0.9 |
| H | Zinc myristate | 6.0 | 15.2 | 3.2 |

Preparation Example 2

Preparation of Positively Chargeable Toner

One hundred parts by mass of a binder resin (polyester resin, Tafton NE-7200, by Kao Co.), 5.5 parts by mass of a release agent (Carnauba wax, Cl, by S. Kato. & Co.), 4 parts by mass of a colorant (carbon black, MA100, by Mitsubishi Chemical Co.), and 5.0 parts by mass of a positively chargeable charge control agent (copolymer of quaternary ammonium salt monomer, product number: FCA201PS, by Fujikurakasei Co.) were mixed at 2400 rpm using a Henschel mixer (by Nippon Coke & Engineering Co.). The resulting mixture was melted and kneaded using a twin screw extruder (PCM-30, by Ikegai Co.) at 5 kg/hr of material feed rate, 160 rpm of shaft rotation number, and 100° C. to 130° C. of cylinder temperature. Then the resulting kneaded material was coarsely pulverized by a Rotoplex mill (Model 8/16, by Toakikai Co.) and then finely pulverized by a jet mill (Model I ultrasonic jet mill, by Nippon Pneumatic Mfg. Co.), and the resulting finely pulverized material was classified by an elbow-jet (Model EJ-LABO, by Nittetsu Mining Co.). The conditions of coarsely pulverizing, finely pulverizing, and classifying were appropriately set to produce toner base particles I to III with different particle diameters and particle size distributions.

To the resulting toner base particles I to III of 100 parts by mass, 1 part by mass of fine particles of hydrophobic silica (RA-200H, by Japan Aerosil Co.) and 0.5 part by mass of titanium oxide fine particles (ST-100, by Titan Kogyo, Ltd.) were added, which were then mixed by a Henschel mixer (FM-20B, by Nippon Coke & Engineering Co.) for 4 minutes to obtain toners I to III. The volume average particle diameter, the content (number %) of particles with a particle diameter of 4 μm or smaller, and the content (volume %) of particles with a particle diameter of 10 μm or larger of the toners I to III measured by the particle size measuring apparatus (Multisizer 3, by Beckman Coulter Inc.) are shown in Table 2.

TABLE 2

| | | Content of particles | |
|---|---|---|---|
| | Volume average particle diameter (μm) | Particle diameter: 4 μm or smaller (number %) | Particle diameter: 10 μm or larger (volume %) |
| Toner I | 6.8 | 5 | 12 |
| Toner II | 5.5 | 18 | 2 |
| Toner III | 8.0 | 2 | 25 |

Example 1

To 101.5 parts by mass of the toner I, 0.1 part by mass of the fatty acid metal salt A was added, then which was mixed by the Henschel mixer (FM-20B, by Nippon Coke & Engineering Co.) for 4 minutes to obtain the mixture of the toner and the fatty acid metal salt.

The resulting mixture of the toner and the fatty acid metal salt was compounded with a carrier (coating: fluorine resin, volume resistivity value: $10^7$ Ω·cm, saturated magnetization: 70 emu/g, average particle diameter: 35 μm, Cu—Zn ferrite carrier, by Powder Tec. Co.) such that the content of the mixture was 12% by mass in the developer, then which was mixed by a ball mill for 30 minutes to prepare a three component developer. The composition of the toner used for preparing the three component developer of Example 1, the amount of fatty acid metal salt used, and the characteristics of particle size distribution thereof are shown in Table 3.

Using the resulting three component developer, and the mixture of the toner I and the fatty acid metal salt A, a durability test of 10000-sheet printing was performed at a coverage rate of 5% by the process described below; after the durability test, image density of resulting image, fog of resulting image, friction coefficient at the surface of the latent image bearing member, charged amount of toner, amount of reversely charged toner, amount of toner dropped in the development device during the durability test, and transfer efficiency during the durability test were evaluated. The evaluation results of the developer of Example 1 are shown in Table 4.

Durability Test

Using a multi-functional apparatus (TASKalfa 500ci, by Kyocera Mita Co.) equipped with the latent image bearing member where a photosensitive layer composed of at least amorphous silicon is formed on a conductive substrate and the cleaning unit having an elastic blade, the three component developer was installed to a black development section of the multi-functional apparatus, and the mixture of the toner I and the fatty acid metal salt A was filled into a toner cartridge for black toner thereof. A voltage (ΔV) between a development sleeve and a magnetic roll was set to 250 V and an AC voltage (Vpp) applied to the magnetic roll was set to 2.0 kV, then 10000-sheet continuous printing was performed at a coverage rate of 5%.

(Image Density)

After the 10000-sheet continuous printing in the durability test, a sample image containing a solid image for evaluation was printed, image densities were measured at 10 random points in the solid image by using an image density meter (Spectroeye, by Gretagmacbeth Co.). An average value of 10 image densities was defined as the value of image density. An image density of 1.2 or more was determined to be OK, and that of less than 1.2 was determined to be NG.

(Fog)

Image densities at 3 random points of non-printing areas of the sample image, were measured by the image density meter (Spectroeye, by Gretagmacbeth Co.). Additionally, an image density of unprinted paper was measured. The value calculated by subtracting the image density of the unprinted paper from the highest image density among 3 image densities at the unprinted areas in the sample image was defined as the value of fog density. A fog density of 0.005 or less was determined to be OK, and that of greater than 0.005 was determined to be NG.

(Friction Coefficient at Surface of Latent Image Bearing Member)

A dynamic friction coefficient between the surface of the latent image bearing member (photoconductor drum) and a wiping cloth (Kimwipes 200S, by Nippon Paper Crecia Co.) was measured using an Autograph (by Shimadzu Co.) and a dedicated tool for measuring a friction coefficient in accordance with JIS 7125. Here, a heavy bob of 216 g was used for measuring the dynamic friction coefficient. Here, the dynamic friction coefficient at the surface of the latent image bearing member was 0.18 before the durability test. A dynamic friction coefficient of 0.50 or less after the durability test was determined to be OK, and that of greater than 0.50 was determined to be NG.

(Amount of Toner Dropped in Development Device)

The tonner dropped in the development device was collected after the durability test and the mass was measured. An amount of dropped toner of 100 mg or less was determined to be OK, and that of greater than 100 mg was determined to be NG.

(Charged Amount of Toner)

A charged amount of the toner collected from the surface of the development sleeve after the durability test, was measured by a QM meter (Model 210HS-1, by Trek Co.). A charged amount of 12 to 27 μC/g was determined to be OK, and that of less than 12 μC/g or greater than 27 μC/g was determined to be NG.

(Transfer Efficiency)

The amount of tonner collected from the cleaning unit was measured after the durability test. The value calculated by subtracting the collected toner amount and the dropped toner amount from the consumed toner amount in the durability test was defined as the transferred toner amount. The ratio of the transferred toner amount versus the consumed toner amount was defined as the transfer efficiency (mass %). A transfer efficiency of 90% by mass or more was determined to be OK, and that of less than 90% by mass was determined to be NG.

(Amount of Reversely Charged Toner)

The toner collected from the surface of a development roller after the durability test was introduced into an E-spurt analyzer (Model EST-III, by Hosokawa Micron Co.), and the amount (mass %) of reversely charged toner in the toner was measured. An amount of reversely charged toner of 1% by mass or less was determined to be OK, and that of greater than 1% was determined to be NG.

Example 2

A three component developer was prepared similarly to Example 1 except that the fatty acid metal salt A was replaced with the fatty acid metal salt B (zinc stearate). The composition of the toner used for preparing the three component developer of Example 2, the amount of fatty acid metal salt used for preparing the three component developer of Example 2, and the characteristics of particle size distribution thereof are shown in Table 3. Using the resulting three component developer, and the mixture of the toner I and the fatty acid metal salt B, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 2 are shown in Table 4.

Example 3

A three component developer was prepared similarly to Example 1 except that the fatty acid metal salt A was replaced with the fatty acid metal salt C (zinc stearate). The composition of the toner used for preparing the three component developer of Example 3, the amount of fatty acid metal salt used for preparing the three component developer of Example 3, and the characteristics of particle size distribution thereof are shown in Table 3. Using the resulting three component developer, and the mixture of the toner I and the fatty acid metal salt C, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 3 are shown in Table 4.

Example 4

A three component developer was prepared similarly to Example 1 except that the fatty acid metal salt A was replaced with the fatty acid metal salt D (calcium stearate). The composition of the toner used for preparing the three component developer of Example 4, the amount of fatty acid metal salt used for preparing the three component developer of Example 4, and the characteristics of particle size distribution thereof are shown in Table 3. Using the resulting three component developer, and the mixture of the toner I and the fatty acid metal salt D, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 4 are shown in Table 4.

Example 5

A three component developer was prepared similarly to Example 1 except that, when the mixture of the toner I and the fatty acid metal salt A was prepared, the amount of the fatty acid metal salt A used was changed from 0.1 part by mass to 0.05 part by mass. The composition of the toner used for preparing the three component developer of Example 5, the amount of fatty acid metal salt used for preparing the three component developer of Example 5, and the characteristics of particle size distribution thereof are shown in Table 3. Using the resulting three component developer, and the mixture of the toner I and the fatty acid metal salt A, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 5 are shown in Table 4.

Example 6

A three component developer was prepared similarly to Example 1 except that, when the mixture of the toner I and the fatty acid metal salt A was prepared, the amount of the fatty acid metal salt A used was changed from 0.1 part by mass to 0.2 part by mass. The composition of the toner used for preparing the three component developer of Example 6, the amount of fatty acid metal salt used for preparing the three component developer of Example 6, and the characteristics of particle size distribution thereof are shown in Table 3. Using the resulting three component developer, and the mixture of the toner I and the fatty acid metal salt A, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 6 are shown in Table 4.

Example 7

A three component developer was prepared similarly to Example 1 except that the toner I was replaced with the toner II. The composition of the toner used for preparing the three component developer of Example 7, the amount of fatty acid metal salt used for preparing the three component developer of Example 7, and the characteristics of particle size distribution thereof are shown in Table 3. Using the resulting three component developer, and the mixture of the toner II and the fatty acid metal salt A, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 7 are shown in Table 4.

Example 8

A three component developer was prepared similarly to Example 1 except that the toner I was replaced with the toner III. The composition of the toner used for preparing the three component developer of Example 8, the amount of fatty acid metal salt used for preparing the three component developer of Example 8, and the characteristics of particle size distribution thereof are shown in Table 3. Using the resulting three component developer, and the mixture of the toner III and the fatty acid metal salt A, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 8 are shown in Table 4.

Example 9

A three component developer was prepared similarly to Example 1 except that the fatty acid metal salt A was replaced with the fatty acid metal salt G (zinc palmitate). The composition of the toner used for preparing the three component developer of Example 9, the amount of fatty acid metal salt used for preparing the three component developer of Example 9, and the characteristics of particle size distribution thereof are shown in Table 3. Using the resulting three component developer, and the mixture of the toner I and the fatty acid metal salt G, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 9 are shown in Table 4.

Example 10

A three component developer was prepared similarly to Example 1 except that the fatty acid metal salt A was replaced with the fatty acid metal salt H (zinc myristate). The composition of the toner used for preparing the three component developer of Example 10, the amount of fatty acid metal salt used for preparing the three component developer of Example 10, and the characteristics of particle size distribution thereof are shown in Table 3. Using the resulting three component developer, and the mixture of the toner I and the fatty acid metal salt H, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Example 10 are shown in Table 4.

Comparative Example 1

A three component developer was prepared similarly to Example 1 except that the fatty acid metal salt A was replaced with the fatty acid metal salt E (zinc stearate). The composition of the toner used for preparing the three component developer of Comparative Example 1, the amount of fatty acid metal salt used for preparing the three component developer of Comparative Example 1, and characteristics of the particle size distribution thereof are shown in Table 3. Using the resulting three component developer, and the mixture of the toner I and the fatty acid metal salt E, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Comparative Example 1 are shown in Table 4. In the durability test using the developer of Comparative Example 1, curling of the elastic blade did not occur; however, strong frictional noise was generated due to the friction between the elastic blade and the surface of the latent image bearing member during the durability test.

Comparative Example 2

A three component developer was prepared similarly to Comparative Example 1 except that, when the mixture of the toner I and the fatty acid metal salt E was prepared, the amount of the fatty acid metal salt E used was changed from 0.1 part by mass to 0.05 part by mass. The composition of the toner used for preparing the three component developer of Comparative Example 2, the amount of fatty acid metal salt used for preparing the three component developer of Comparative Example 2, and the characteristics of particle size distribution thereof are shown in Table 3. Using the resulting three component developer, and the mixture of the toner I and the fatty acid metal salt E, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Comparative Example 2 are shown in Table 4. Here, during the durability test using the developer of Comparative Example 2, curling of the elastic blade occurred when about 8000 sheets had been printed. For this reason, the elastic blade was replaced during the durability test.

Comparative Example 3

A three component developer was prepared similarly to Comparative Example 1 except that, when the mixture of the toner I and the fatty acid metal salt E was prepared, the amount of the fatty acid metal salt E used was changed from 0.1 part by mass to 0.2 part by mass. The composition of the toner used for preparing the three component developer of Comparative Example 3, the amount of fatty acid metal salt used for preparing the three component developer of Comparative Example 2, and the characteristics of particle size distribution thereof are shown in Table 3. Using the resulting three component developer, and the mixture of the toner I and the fatty acid metal salt E, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Comparative Example 3 are shown in Table 4.

Comparative Example 4

A three component developer was prepared similarly to Example 1 except that the fatty acid metal salt A was replaced with the fatty acid metal salt F (zinc stearate). The composition of the toner used for preparing the three component developer of Comparative Example 4, the amount of fatty acid metal salt used for preparing the three component developer of Comparative Example 4, and the characteristics of particle size distribution thereof are shown in Table 3. Using the resulting three component developer, and the mixture of the toner I and the fatty acid metal salt F, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Comparative Example 4 are shown in Table 4. Here, during the durability test using the developer of Comparative Example 4, curling of the elastic blade occurred when about 6000 sheets had been printed. For this reason, the elastic blade was replaced during the durability test.

Comparative Example 5

A three component developer was prepared similarly to Comparative Example 4 except that, when the mixture of the toner I and the fatty acid metal salt F was prepared, the amount of the fatty acid metal salt F used was changed from 0.1 part by mass to 0.05 part by mass. The composition of the toner used for preparing the three component developer of Comparative Example 5, the amount of fatty acid metal salt used for preparing the three component developer of Comparative Example 5, and the characteristics of particle size distribution thereof are shown in Table 3. Using the resulting three component developer, and the mixture of the toner I and the fatty acid metal salt F, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Comparative Example 5 are shown in Table 4. Here, during the durability test using the developer of Comparative Example 5, curling of the elastic blade occurred when about 4000 sheets had been printed. For this reason, the elastic blade was replaced during the durability test; however, curling of the elastic blade further occurred when about 5500 sheets and also about 9000 sheets had been printed.

Comparative Example 6

A three component developer was prepared similarly to Comparative Example 4 except that, when the mixture of the toner I and the fatty acid metal salt F was prepared, the amount of the fatty acid metal salt F used was changed from 0.1 part by mass to 0.2 part by mass. The composition of the toner used for preparing the three component developer of Comparative Example 6, the amount of fatty acid metal salt used for preparing the three component developer of Comparative Example 6, and the characteristics of particle size distribution thereof are shown in Table 3. Using the resulting three component developer, and the mixture of the toner I and the fatty acid metal salt F, image density of resulting image, fog of resulting image, friction coefficient at the surface of the latent image bearing member, amount of toner dropped in the development device, charged amount of toner, transfer efficiency, and amount of reversely charged toner after the durability test were evaluated similarly to Example 1. The evaluation results of the developer of Comparative Example 6 are shown in Table 4. Here, during the durability test using the developer of Comparative Example 6, curling of the elastic blade did not occur.

TABLE 3

| | Composition of developer | | | | | | | | |
|---|---|---|---|---|---|---|---|---|---|
| | Toner | | | | Fatty acid metal salt | | | | |
| | | Composition of toner (part by mass) | | | | | Volume average particle diameter (μm) | Content of particles (volume %) | |
| | Type | Base particles | Silica | Titanium oxide | Type | Parts by mass | | Particle diameter: 3 μm or smaller | Particle diameter: 10 μm or larger |
| Example 1 | I | 100 | 1 | 0.5 | A | 0.1 | 6.1 | 10.3 | 3.4 |
| Example 2 | I | 100 | 1 | 0.5 | B | 0.1 | 4.3 | 19.3 | 1.2 |
| Example 3 | I | 100 | 1 | 0.5 | C | 0.1 | 7.9 | 7.8 | 4.9 |
| Example 4 | I | 100 | 1 | 0.5 | D | 0.1 | 6.2 | 12.4 | 2.3 |
| Example 5 | I | 100 | 1 | 0.5 | A | 0.05 | 6.1 | 10.3 | 3.4 |
| Example 6 | I | 100 | 1 | 0.5 | A | 0.2 | 6.1 | 10.3 | 3.4 |
| Example 7 | II | 100 | 1 | 0.5 | A | 0.1 | 6.1 | 10.3 | 3.4 |
| Example 8 | III | 100 | 1 | 0.5 | A | 0.1 | 6.1 | 10.3 | 3.4 |
| Example 9 | I | 100 | 1 | 0.5 | G | 0.1 | 6.3 | 13.6 | 0.9 |
| Example 10 | I | 100 | 1 | 0.5 | H | 0.1 | 6.0 | 15.2 | 3.2 |
| Comparative Example 1 | I | 100 | 1 | 0.5 | E | 0.1 | 2.4 | 25.6 | 0.5 |
| Comparative Example 2 | I | 100 | 1 | 0.5 | E | 0.05 | 2.4 | 25.6 | 0.5 |

TABLE 3-continued

| Composition of developer | | | | | | | | | |
|---|---|---|---|---|---|---|---|---|---|
| | Toner | | | | Fatty acid metal salt | | | | |
| | | Composition of toner (part by mass) | | | | | Volume average particle diameter (μm) | Content of particles (volume %) | |
| | Type | Base particles | Silica | Titanium oxide | Type | Parts by mass | | Particle diameter: 3 μm or smaller | Particle diameter: 10 μm or larger |
| Comparative Example 3 | I | 100 | 1 | 0.5 | E | 0.2 | 2.4 | 25.6 | 0.5 |
| Comparative Example 4 | I | 100 | 1 | 0.5 | F | 0.1 | 8.7 | 4.2 | 10.2 |
| Comparative Example 5 | I | 100 | 1 | 0.5 | F | 0.05 | 8.7 | 4.2 | 10.2 |
| Comparative Example 6 | I | 100 | 1 | 0.5 | F | 0.2 | 8.7 | 4.2 | 10.2 |

TABLE 4

| Evaluation result of developer (numerical result of the evaluation/determination) | | | | | | | |
|---|---|---|---|---|---|---|---|
| | Image density | Fog | Dynamic friction coefficient | Amount of dropped toner (mg) | Charge carried by toner (μC/g) | Transfer efficiency (mass %) | Amount of reversely charged toner (mass %) |
| Example 1 | 1.374/OK | 0.002/OK | 0.33/OK | 52/OK | 18.7/OK | 96/OK | 0.23/OK |
| Example 2 | 1.453/OK | 0.004/OK | 0.39/OK | 25/OK | 13.5/OK | 92/OK | 0.75/OK |
| Example 3 | 1.358/OK | 0.002/OK | 0.45/OK | 82/OK | 22.4/OK | 95/OK | 0.12/OK |
| Example 4 | 1.370/OK | 0.003/OK | 0.47/OK | 85/OK | 25.0/OK | 98/OK | 0.22/OK |
| Example 5 | 1.226/OK | 0.002/OK | 0.47/OK | 32/OK | 24.2/OK | 91/OK | 0.13/OK |
| Example 6 | 1.432/OK | 0.003/OK | 0.20/OK | 84/OK | 15.2/OK | 97/OK | 0.40/OK |
| Example 7 | 1.282/OK | 0.002/OK | 0.39/OK | 65/OK | 23.4/OK | 92/OK | 0.52/OK |
| Example 8 | 1.423/OK | 0.002/OK | 0.35/OK | 50/OK | 16.2/OK | 96/OK | 0.20/OK |
| Example 9 | 1.427/OK | 0.004/OK | 0.33/OK | 52/OK | 15.4/OK | 92/OK | 0.83/OK |
| Example 10 | 1.411/OK | 0.003/OK | 0.37/OK | 48/OK | 13.2/OK | 92/OK | 0.72/OK |
| Comparative Example 1 | 1.472/OK | 0.012/NG | 0.53/NG | 35/OK | 12.5/OK | 82/NG | 4.30/NG |
| Comparative Example 2 | 1.401/OK | 0.004/OK | 0.58/NG | 32/OK | 13.0/OK | 80/NG | 0.80/OK |
| Comparative Example 3 | 1.496/OK | 0.020/NG | 0.47/OK | 60/OK | 11.5/NG | 93/NG | 6.00/NG |
| Comparative Example 4 | 1.302/OK | 0.002/OK | 0.61/NG | 175/NG | 19.3/OK | 87/NG | 0.25/OK |
| Comparative Example 5 | 1.350/OK | 0.002/OK | 0.65/NG | 82/OK | 18.0/OK | 85/NG | 0.22/OK |
| Comparative Example 6 | 1.362/OK | 0.005/OK | 0.42/OK | 202/NG | 17.3/OK | 86/NG | 0.33/OK |

It is understood from Examples 1 to 10 that when the developer includes a positively chargeable toner and a fatty acid metal salt, the fatty acid metal salt being a metal salt selected from the group consisting of zinc, calcium, and magnesium salts of fatty acids of 12 to 20 carbon atoms, and the fatty acid metal salt having a content of particles with a particle diameter of 3 μm or smaller of 20% by volume or less, and a content of particles with a particle diameter of 10 μm or larger of 5% by volume or less, even when images are formed by an image forming apparatus which is equipped with a latent image bearing member where a photosensitive layer composed of at least amorphous silicon is formed on a conductive substrate and a cleaning unit that has an elastic blade, the increase in friction coefficient at the surface of the latent image bearing member after continuously forming images for a long period can be suppressed, toners can be charged to a desired charged amount, and the toner scattering from development units or generation of image defects such as fog in the resulting images can be reduced by suppressing the generation of a reversely charged toner.

The developer of Comparative Example 1 includes the fatty acid metal salt E having a larger content of fine particles with a particle diameter of 3 μm or smaller, therefore, the fine particles of the fatty acid metal salt tend to adhere to the toner. Consequently, with the developer of Comparative Example 1, the fatty acid metal salt becomes resistant to be supplied to the surface of the latent image bearing member, the dynamic friction coefficient increases at the surface of the latent image bearing member after the durability test, and a large amount of the reversely charged toner is generated. Moreover, with the developer of Comparative Example 1, fog is present in the resulting images after the durability test since a large amount of the reversely charged toner is generated.

The developer of Comparative Example 2 includes the fatty acid metal salt E having a larger content of fine particles similarly to Comparative Example 1, but the content of the fatty acid metal salt E is less than that of Comparative Example 1. Consequently, with the developer of Comparative Example 2, the generated amount of reversely charged toner is relatively less after the durability test. However, the content of the fatty acid metal salt is relatively less in the developer of Comparative Example 2, therefore, the fatty acid metal salt becomes more resistant to be supplied to the surface of the latent image bearing member, and the dynamic friction coefficient tends to increase at the surface of the latent image bearing member in the durability test.

The developer of Comparative Example 3 includes the fatty acid metal salt E having a larger content of fine particles similarly to Comparative Example 1, but the content of the fatty acid metal salt E is larger than that of Comparative Example 1. Consequently, the content of the fatty acid metal salt is absolutely large in the developer of Comparative Example 3, thus the fatty acid metal salt is properly supplied to the surface of the latent image bearing member even under the state that the fine particles of the fatty acid metal salt tend to adhere to the toner, consequently, the dynamic friction coefficient is unlikely to increase at the surface of the latent image bearing member. However, the developer of Comparative Example 3 includes a large amount of the negatively chargeable fatty acid metal salt, therefore, a large amount of reversely charged toner tends to be generated, and thus decrease in charged amount of the toner and fog in the resulting images are likely to occur.

The developer of Comparative Example 4 includes the fatty acid metal salt F having a larger content of coarse particles with a particle diameter of 10 μm or larger. Consequently, by using the developer of Comparative Example 4, the toner tends to drop together with the coarse particles of the fatty acid metal salt, the amount of dropped toner is remarkably large, and transfer efficiency is lower. Moreover, by using the developer of Comparative Example 4, the coarse particles of the fatty acid metal salt tend to drop in the development device, thus the fatty acid metal salt becomes resistant to be properly supplied to the surface of the latent image bearing member, and the dynamic friction coefficient tends to increase at the surface of the latent image bearing member by the durability test.

The developer of Comparative Example 5 includes the fatty acid metal salt F having a larger content of coarse particles similarly to Comparative Example 4, but the content of the fatty acid metal salt F is less than that of Comparative Example 4. Consequently, the developer of Comparative Example 5 represents a smaller amount of dropped toner after the durability test. However, the developer of Comparative Example 5 includes a less content of the fatty acid metal salt, therefore, the fatty acid metal salt becomes further resistant to be supplied to the surface of the latent image bearing member compared to the developer of Comparative Example 4, and the dynamic friction coefficient tends to remarkably increase at the surface of the latent image bearing member by the durability test.

The developer of Comparative Example 6 includes the fatty acid metal salt F having a larger content of fine particles similarly to Comparative Example 4, but the content of the fatty acid metal salt F is larger than that of Comparative Example 4. Consequently, the content of the fatty acid metal salt is absolutely large in the developer of Comparative Example 6, thus the fatty acid metal salt is properly supplied to the surface of the latent image bearing member even under the state that the coarse particles of the fatty acid metal salt tend to drop in the development device, and the dynamic friction coefficient is unlikely to increase at the surface of the latent image bearing member. However, by using the developer of Comparative Example 6, the toner tends to drop in the development device together with the coarse particles of the fatty acid metal salt, thus image smear generated due to the influence of scattering of the dropped toner.

What is claimed is:

1. A developer for electrostatic latent image development, used for an image forming apparatus which is equipped with a latent image bearing member where a photosensitive layer composed of at least amorphous silicon is formed on a conductive substrate and a cleaning unit that has an elastic blade, wherein the developer comprises a positively chargeable toner and a fatty acid metal salt, the fatty acid metal salt is a metal salt selected from the group consisting of zinc, calcium, and magnesium salts of fatty acids of 12 to 20 carbon atoms, and the fatty acid metal salt has a content of particles with a particle diameter of 3 μm or smaller of 20% by volume or less, and a content of particles with a particle diameter of 10 μm or larger of 5% by volume or less.

2. The developer for electrostatic latent image development according to claim 1, wherein the fatty acid metal salt is a metal salt of an acid selected from the group consisting of stearic acid, palmitic acid, and myristic acid.

3. The developer for electrostatic latent image development according to claim 2, wherein the fatty acid metal salt is a metal salt of stearic acid.

4. The developer for electrostatic latent image development according to claim 1, wherein the fatty acid metal salt has a volume average particle diameter of 4 to 8 μm.

5. The developer for electrostatic latent image development according to claim 1, wherein the content of the fatty acid metal salt is 0.01 to 0.5 part by mass based on 100 parts by mass of the positively chargeable toner.

6. An image forming method, for forming an image using a developer for electrostatic latent image development in an image forming apparatus which is equipped with a latent image bearing member where a photosensitive layer composed of at least amorphous silicon is formed on a conductive substrate and a cleaning unit that has an elastic blade, wherein the developer comprises a positively chargeable toner and a fatty acid metal salt, the fatty acid metal salt is a metal salt selected from the group consisting of zinc, calcium, and magnesium salts of fatty acids of 12 to 20 carbon atoms, and the fatty acid metal salt has a content of particles with a particle diameter of 3 μm or smaller of 20% by volume or less, and a content of particles with a particle diameter of 10 μm or larger of 5% by volume or less.

7. The image forming method according to claim 6, wherein the fatty acid metal salt is a metal salt of an acid selected from the group consisting of stearic acid, palmitic acid, and myristic acid.

8. The image forming method according to claim 7, wherein the fatty acid metal salt is a metal salt of stearic acid.

9. The image forming method according to claim 6, wherein the fatty acid metal salt has a volume average particle diameter of 4 to 8 μm.

10. The image forming method according to claim 6, wherein the content of the fatty acid metal salt in the developer for electrostatic latent image development is 0.01 to 0.5 part by mass based on 100 parts by mass of the positively chargeable toner.

* * * * *